United States Patent [19]

Bougaran

[11] 4,333,196

[45] Jun. 8, 1982

[54] DEVICE AND METHOD OF TRANS-SHIPMENT BETWEEN A SHIP AND A FIXED STRUCTURE SITUATED AT SEA

[75] Inventor: Alain P. Bougaran, Marseilles, France

[73] Assignee: Compagnie Chambon, Marseilles, France

[21] Appl. No.: 214,630

[22] Filed: Dec. 10, 1980

[30] Foreign Application Priority Data

Dec. 12, 1979 [FR] France ..... 79 30808

[51] Int. Cl.[3] ..... E01D 1/00

[52] U.S. Cl. ..... 14/71.7

[58] Field of Search ..... 14/69.5, 36, 71.1, 71.3, 14/71.7; 114/230, 270; 405/219

[56] References Cited

U.S. PATENT DOCUMENTS

| | | | |
|---|---|---|---|
| 3,276,059 | 10/1966 | Allen | 14/36 |
| 3,317,942 | 5/1967 | Wollard | 14/71.5 |
| 3,884,043 | 5/1975 | Timmermans | 14/71.1 X |
| 4,035,861 | 7/1977 | Edge | 14/71.1 |
| 4,083,072 | 4/1978 | Ryan | 14/69.5 |
| 4,133,283 | 1/1979 | Ryan | 14/71.1 X |
| 4,162,551 | 7/1979 | Serrano | 14/69.5 |

FOREIGN PATENT DOCUMENTS

| | | | |
|---|---|---|---|
| 2833357 | 2/1980 | Fed. Rep. of Germany | 14/69.5 |

*Primary Examiner*—Nile C. Byers, Jr.

[57] ABSTRACT

The invention relates to devices of trans-shipment between a ship and a fixed structure situated at sea, which devices comprise a directable gangway, one end of which is mounted to pivot about a vertical axle fixed to the fixed structure, the second end comprising an air cushion designed to rest on a free area of the ship's deck.

12 Claims, 4 Drawing Figures

DEVICE AND METHOD OF TRANS-SHIPMENT BETWEEN A SHIP AND A FIXED STRUCTURE SITUATED AT SEA

The present invention relates to devices and to a method for the trans-shipment of crews and light equipment between a ship and a fixed structure, such as an oil prospecting platform, a buoy, an isolated lighthouse, a berthed oil-tanker used as a storage tanker, and any other similar fixed or semi-fixed structure out at sea.

The technical sector of the invention is that of the construction of sea transport and sea prospection equipment.

The development of oil prospections at sea makes it necessary to effect frequent transfers of crews and light equipment between ships and fixed structures at sea, in non-sheltered water exposed to swells.

At the moment, such transfers can be carried out by way of a cage or of a net, suspended to a crane integral with the fixed structure. This system is very dangerous since the boat is subjected to swells, which can lead to sudden impacts between the cage or the net and the ship's deck.

Rubber crafts are also used, to and fro between the boat and the structure. The crew climbs up the structure by ladders fixed on said structure. There are great risks of men falling into the sea and this form of transfer is only possible when the sea is relatively calm.

Trans-shipping gangways have been proposed to overcome these drawbacks. For example, metallic gangways or ramps are known which are disposed in console form with respect to the fixed structure on which they are mounted for pivoting about two axes, a vertical axis and a horizontal axis. The boat comes close to the fixed structure, the free end of the gangway is brought to rest against the rear end of the ship's deck, and locked thereon.

A main disadvantage with this type of gangway resides in the fact that it constitutes a rigid link between the ship which is subjected to movements and the structure which is fixed or semi-fixed. Such gangways are subjected to high stresses and they need to be very heavy to resist the horizontal movements of the ship.

Moreover, the gangway has to be secured to the fixed structure at a high enough level to be out of the reach of the crests of the waves at high tide. Therefore, when the tide is low, there is a considerable difference in level between the ship's deck and the end of the gangway fixed on the structure. If such a gangway is relatively short, then the rising gradient is steep, which makes the trans-shipment of equipment difficult. To avoid too steep a gradient, the gangway has to be longer, which increases the costs and complicates the handling of the gangway.

Other known trans-shipment devices are carried by the ship and are composed of an extending gangway, such as for example a gangway comprising a flexible belt with roller.

It is an object of the present invention to propose trans-shipment devices, of the directional gangway type mounted for pivoting on the fixed structure about at least one vertical axle, which overcome the disadvantages of the currently known gangways and also allow the boat to follow freely the movement of the swell without creating stresses in the gangway, this permitting the construction of lighter gangways than those used up to now.

Another object of the invention is to procure trans-shipment devices which can equip unmanned fixed structures, with no source of energy of their own.

The trans-shipment means according to the invention comprise, in known manner, a directional gangway, one end of which is mounted for pivoting on a fixed structure about a vertical axle, and means for directing the gangway in the axis of a ship by pivoting it about the said vertical axis.

The objects of the invention are reached with gangways of this known type, which further comprise an air cushion designed to rest on a free area of the ship's deck to support the second end of the gangway by a simple sliding support.

Preferably, trans-shipment means according to the invention comprise a stairway which is pivotally joined to the second end of the gangway and which rests on a free area of the ship's deck by means of an air cushion.

Preferably also, the lower end of the stairway is joined to the air-cushion by means of an oil and air suspension and a swivel joint.

A special device according to the invention comprises a directional drum which pivots about a vertical axle and comprises two portions of vertical cylinder, centred on the said vertical axle and two arms connecting together two ends of the said cylinder portions, which arms and cylinder portions are symmetrical in pairs with respect to an axial plane, and it comprises two ropes of equal length one end of which is secured respectively to the free end of each arm, the other ends being fixed to a joint securing member which is designed to be moored to the rear end of the ship so that when said ship pulls on the ropes said ropes rest against the cylinder portions and exert on the directional drum a constant torque which brings the said axial plane of symmetry and the directional gangway in the axis of the ship.

According to an embodiment of the invention, the gangway is composed of longitudinal side-members and of a girder which form a parallelogram articulated about four horizontal axle two of which are pivotally mounted on the structure supporting the stairway.

According to another embodiment, the device according to the invention comprises a directional gangway substantially horizontal and the stairway connecting the free end of the gangway to the ship's deck is an extending stairway composed of a plurality of flights, hinged to one another and folding or unfolding under the action of a jack and of connecting rods, the lower end of the lower flight being fitted with an air cushion which comes to rest on the ship's deck.

The effect of the invention is a new means for transferring crews, equipment or food supplies from a ship to a fixed and unsheltered structure at sea, such as for example an oil prospecting platform at sea or any other similar fixed or semifixed structure.

The trans-shipment means according to the invention are designed to serve structures implanted at sea which may be manned or unmanned and which may or may not have their own source of energy.

The trans-shipment means according to the invention rest on a free area situated at the back end of the ship's deck, by way of an air cushion which constitutes a simple support, sliding freely on the deck. As a result, the axial horizontal movements of the ship cause an axial sliding of the air cushion, thus creating no stresses in the gangway whose construction can as result be lighter.

The transverse horizontal movements of the boat are compensated by the rotation of the gangway about its vertical rotating axis.

As to the vertical movements of the ship, these take the form of a pivoting movement of the gangway in the vertical plane in the case of an inclinable gangway. In the case of a non-inclinable horizontal gangway, an extending stairway, composed of a plurality of hinged-together flights is inserted between the gangway and the ship's deck and thus, the vertical movements of the ship are compensated by the variations of the overall height of the extending stairway. In both cases, the stairway permits to step over any obstacles that could be found at the rear end of the ship.

In the case of an inclinable gangway, a flight of stairs is added thereto, this permitting to reduce the rising gradient of the ramp at low tide.

The pivoting drum with which are fitted the means according to the invention, combined with two ropes of equal length forming a mooring bridle, moored to the boat and held stretched by said drum, permits to keep the direction of the gangway in the axis of the ship with a constant torque throughout the duration of the transfer.

The invention will be more readily understood on reading the following description with reference to the accompanying drawings, in which.

Figure 1:
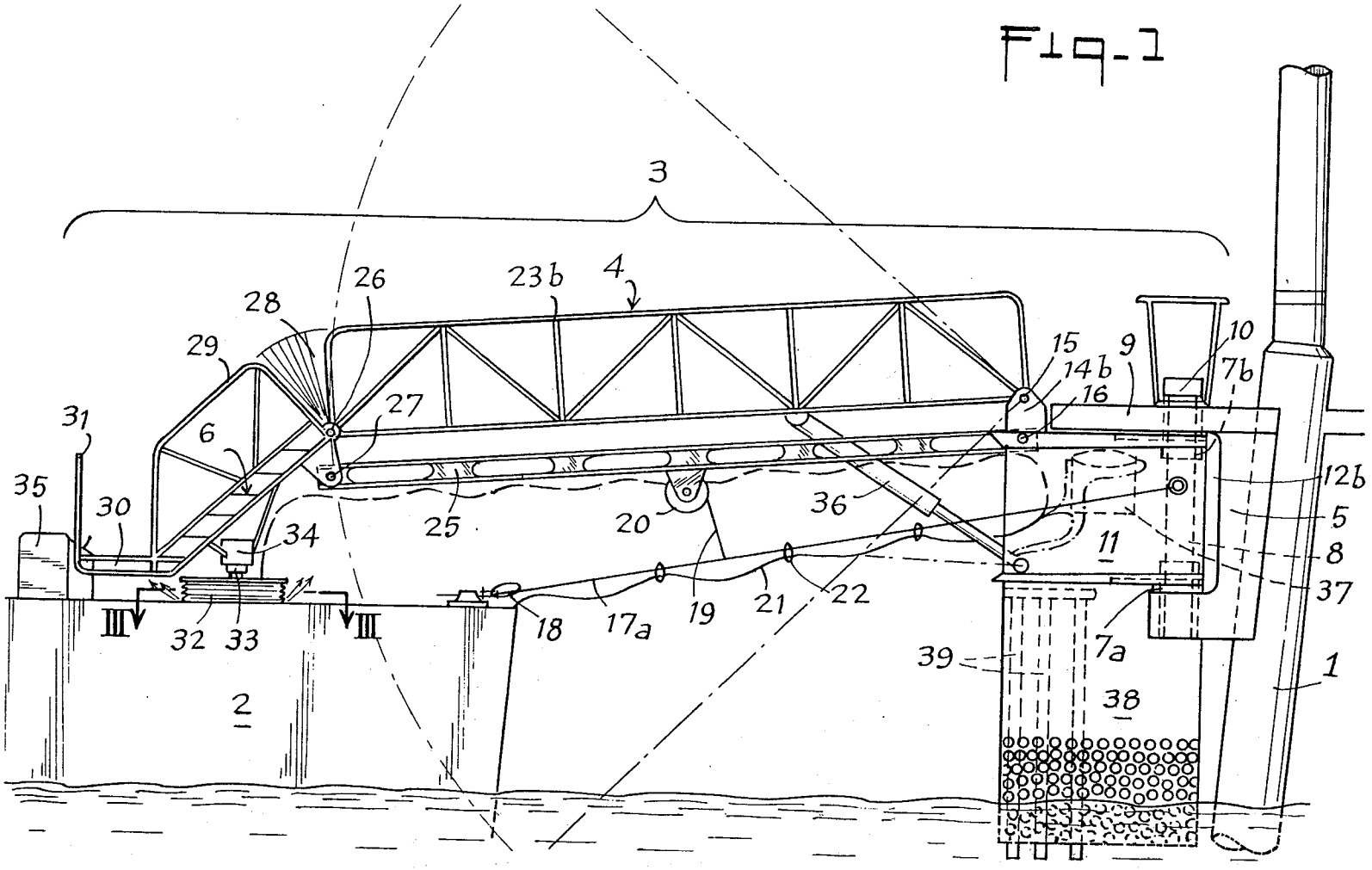
FIG. 1 is an elevational view of a trans-shipment gangway according to the invention.
Figure 2:
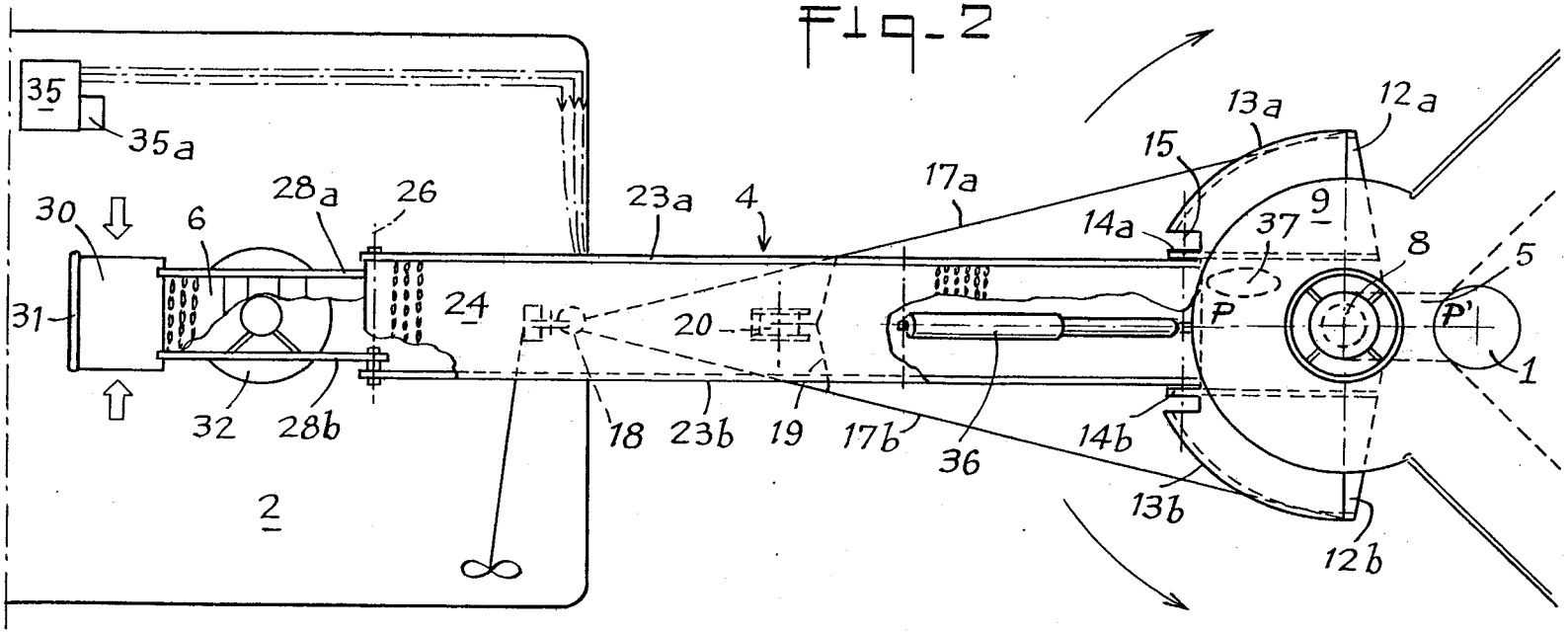
FIG. 2 is a view from above of FIG. 1 with torn parts.

FIGS. 1 and 2 show a part 1 of a fixed structure situated at sea, for example an angle pier of an oil prospecting platform or of any other similar structure such as an oceanographic buoy, a beacon, a lighthouse, etc . . . The reference 2 shows the rear end of a ship bringing crews and/or light equipment to the structure. The ship may be any known type used to bring food and equipment supplies to the structure or to change the working crews.

The structure 1 may also be a semi-fixed structure such as an oil storage tanker or a repair-or hotel-ship, laying at anchor.

The trans-shipment device according to the invention is designed to be used with unmanned structures with no source of energy of their own.

The reference 3 designates the whole trans-shipment assembly for transferring crews and equipment from the ship to the structure and viceversa. The trans-shipment device comprises a gangway 4 which is pivotally joined to a bracket 5 fixed to the structure 1. It further comprises at the end opposite said bracket, a stairway 6 connecting the gangway to the rear end of the ship's deck 2. The bracket 5 is secured, by welding for example, to an angle pier 1 of the structure and projects therefrom. It supports two bearings 7*a* and 7*b* inside which pivots a vertical axle 8. The upper end of the bracket 5 forms a circular platform 9 of access to the gangway 4, which is centered on the axis 8.

In order to prevent any sudden jerky rotation movements of the gangway about the axle 8, the head of said axle 8, which projects above the platform 9 is associated to a rotary dampening means 10.

The vertical axle 8 supports a directional drum 11 comprising at the front two portions of a cylinder 13*a* and 13*b* centered on the axle 8 and, at the rear, two arms 12*a* and 12*b* connecting together the rear ends of the cylinder portions.

The arms 12*a* and 12*b* are symmetrical with respect to an axial plane PP' as well as the two cylinder portions 13*a* and 13*b*.

The drum 11 comprises two vertical bearing-plates 14*a* and 14*b* symmetrical with respect to the plane PP', which support two horizontal axles 15 and 16, perpendicular to said plane PP', and on which is hingedly mounted the gangway 4. At the ends of the two arms 12*a* and 12*b* are fixed two flexible lines 17*a* and 17*b* of equal length, for example two polyamide ropes, two cables or two bands, converging towards a common hooking member 18, for example towards a ring, and forming a bridle. The two lines 17*a* and 17*b* rest on the surface of the cylinders 13*a* and 13*b* so that when pulling on the bridle, the torque exerted on the drum 11 remains constant whatever the position of the bridle.

It is shown in FIG. 1 that the lines 17*a* and 17*b* are held by a band 19 which is wound on a spring roller 20 fixed under the gangway.

In the example illustrated in FIG. 1, the lines 17*a* and 17*b* support an umbilical cable 21 which is suspended to the lines of the bridle, for example by way of rings or elastic slings 22. The umbilical cable 21 comprises several conduits in which flow the compressed fluids used to manoeuver and hold the gangway. The sources of compressed fluid are on the ship 2. The gangway 4 is composed of two superimposed metallic structures hingedly connected together to form an articulated parallelogram.

The upper structure is formed by two side-members 23*a* and 23*b* connected together by crosspieces and forming a flooring 24, for example a perforated or corrugated sheet metal flooring or a grill-flooring used as an access ramp. The two side-members form a lattice structure which is visible in FIG. 1 and serve as guard-rails on either side of the ramp.

The lower structure is constituted by a girder 25 or by two girders connected together by cross-pieces.

The ends of the side-members 23*a* and 23*b* and of the girder 25 which are opposite the fixed structure 1 are mounted for pivoting about two horizontal axles 26 and 27. Said axles 26 and 27 pivot in two bearing plates 28*a* and 28*b* supporting the steps of the stairway 6.

The bearing plates 28*a* and 28*b* are also provided with guard-rails 29 framing the stairway. The lower end of the flight of stairs 6 comprises a stepping platform 30 equipped with a guard-rail 31 which faces the stairway. Said platform 30 is slightly wider than the stairway, this making it easier of access from the ship's deck.

Due to the construction of the gangway, in the form of an articulated parallelogram, one side of which supports, via the hinges 26, 27, a slight of stairs 6, said side 26, 27 is always parallel to itself and the steps remain horizontal whatever the inclination of the gangway under the effect of the swell.

One advantage of adding a stairway to the gangway is that it reduces the inclination of the gangway even at low tide, this facilitating the transfer of equipment.

Another advantage of adding steps hingedly mounted on the end of a gangway which is slightly sloping down towards the ship's deck resides in the fact that horizontal displacements of the bearing surface of the stairway on the deck of the boat are very limited since the axial horizontal displacements of the free end of the gangway are compensated to a large extent by the variations of the angle formed by the stairway 6 and the gangway 4.

The flight of stairs 6 rests on the deck of the ship 2 via a means 32, of the air cushion type, constituted by an assembly of vertical skirts opened at their lower end and in which compressed air is injected, which compressed air is released at the periphery of the lower end of the said skirts.

Figure 3:
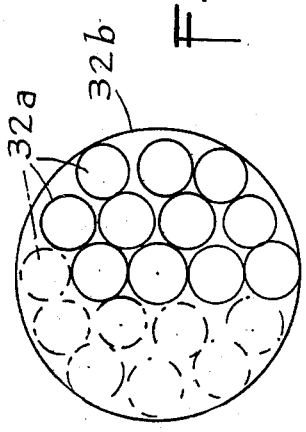
FIG. 3 is a partial cross-section along III—III of FIG. 1.

FIG. 3 shows a horizontal cross-section along III—III of the air-cushion 32. It is seen from said Figure that the air cushion comprises an assembly of cylindrical skirts 32*a* placed inside a skirt 32*b* enclosing them. Said skirts 32*a* and 32*b* are vertical cylinders in supple material such as for example artificial rubber or elastomer.

Due to this particular construction of the air cushion composed of a plurality of juxtaposed skirts, if one of the skirts is damaged or passes over a drop in level, the other skirts continue to play their lifting part.

The skirts are supplied with compressed air, for example through a conduit passing under the gangway and then in the umbilical 21 and connecting them to a compressor 35 provided on the ship 2.

The air cushion 32 is connected to the flight of stairs by a swivel joint 33 allowing the said air cushion to follow freely the rolling and pitching of the ship and its whole surface to remain in close contact with the ship's deck.

An oil and air suspension 34 is inserted between the joint 33 and the flight of stairs. Its function is to dampen the impacts of the air cushion on the deck, especially when the gangway goes down.

The air cushion 32 is a simple support for the stairway and the gangway on the ship's deck and said support can slide without friction in every direction provided there is an obstacle-free area astern of the ship. As a result, the axial horizontal movements of the ship are not transmitted to the gangway, this preventing any high stresses from arising in the gangway, which gangway can, as a result be a lighter construction. Moreover, any shocks arising will not be transmitted to the fixed structure.

As a variant, the air cushion can be supplied with compressed air from a blower which is fixed under the gangway or under the stairway and which is driven by an electric motor fed in electricity from a conductor passing in the umbilical 21 and connecting the said motor to a source of electrical power provided on the ship.

According to another variant, when the device does not require any umbilical for other purposes, it is possible to supply the air cushion directly from the ship, after bringing down the cushion close to the ship's deck, and branching a flexible compressed air line connected to a compressor on a connector provided on the air cushion.

The trans-shipment device further comprises means for controlling the raising of the gangway 4.

In the embodiment shown in FIG. 1, said means is a hydraulic jack 36 which is hingedly mounted first on the drum 11 and second on the gangway 4. This jack is supplied in pressurized oil via a conduit passing inside the unbilical 21 and connecting it to a hydraulic unit provided on the ship.

The jack 36 can be replaced by any other equivalent means. For example, it can be replaced by a counterweight which is connected to the gangway 4 via a cable passing over a return pulley and which is associated to a hydraulic brake to prevent too rapid a raising of the gangway.

In this case, as the counterweight balances the weight of the gangway, a vertical force has to be exerted on the latter which force will tend to keep it in resting contact on the ship's deck.

According to a first embodiment, a reservoir with an opening bottom is placed under the stairway 6. Said bottom is manoeuvered for example by a small jack.

When the gangway has been brought into a resting position by pulling on a manoeuvering rope, the opening bottom is closed, then the reservoir is filled with liquid whose weight furnishes the bearing force which holds the air cushion in contact with the deck.

A small winch of constant tension placed at the back of the ship permits to wind the manoeuvering rope hanging under the gangway, in order to bring down the latter towards the ship when said ship approaches the fixed structure.

In case of a breakdown of the pneumatic source or of breakage of the air cushion flexible supply pipe, the jack operating the closure of the opening bottom of the reservoir, which is an opening jack through lack of pressure, controls the opening of the reservoir which empties instantly and the gangway is raised up under the action of the counterweight before the air cushion can be damaged.

According to another variant, the water tank can be replaced by a second counterweight which is fixed under the gangway 4 and which can be moved longitudinally by an auxiliary jack posing a return means, such as for example a spring or an oil and air tank which tends to return the second counterweight towards a rest position situated close to the horizontal axles 15 and 16. In this rest position, the second counterweight does not exert enought of a torque to counterbalance the gangway lifting torque exerted by the first counterweight. When the gangway is brought down in contact with the deck, the second counterweight is moved apart from the axles 15 and 16 and then exerts on the gangway a vertical force which is sufficient to maintain the air cushion in resting contact with the deck.

The device shown in FIGS. 1 and 2 further comprises, preferably, an oil and air accumulator 37 which is placed for example inside the drum 11. In the event of the umbilical 21 breaking or of a breakdown of the hydraulic unit supplying the jack 36, the accumulator 37 is automatically connected to the jack 36 and the energy accumulated in the form of pressure in the accumulator 37 is sufficient to ensure the raising of the gangway 4.

The reducing to practice of the trans-shipment device according to FIGS. 1 and 2 comprises the following steps.

When the ship arrives close to the structure 1, which may be unmanned, the gangway 4 is in the raised position out of the reach of the crests of the waves. The two ropes 17*a* and 17*b* which constitute the bridle and support the umbilical are held under the gangway by the spring roller 20. The gangway is preferably implanted on the side of the fixed structure facing away from the direction of the prevailing winds. The ship 2 approaches the fixed structure 1 stern first. It is directed so as to come within the most sheltered sector. A member of the crew, posted on the after-deck of the ship, hooks the loop 18 with a boathook and brings it towards the ship to moor it. He then connects the umbilical 21 with the connectors provided to this effect.

The ship then starts slowly to move forward, which stretches the ropes 17*a* and 17*b*. Said ropes exert a torque on one of the arms 12*a* or 12*b*, causing the drum 11 to rotate about the vertical axis 8. The gangway is directed so as to be brought straight up above the ship's deck. The ship's propellers are then run at high speed to stretch the bridle, thus keeping the gangway in the longitudinal axis of the ship. The officer on deck controlling the manoeuvering of the gangway has a control desk 35*a* from where he controls the jack 36 via the umbilical 21 and can supply the air cushion 32 with compressed air. He then controls the jack 36 which allows the gangway to descend towards the ship's deck by pivoting it about the horizontal axles 15 and 16. The operator can vary the speed of the jack by acting on the rate of flow of the oil. Initially, the gangway must be brought down vary fast. Then, when it approaches the deck, it is slowed down so that the air cushion can contact with the ship's deck, moving with the swell, at a very low speed, and preferably at the moment when the ship is on the crest of a wave.

At the moment of contact, the kinetic energy of the gangway is absorbed both by the air cushion 32 and by the suspension 34 which may be an oil and air reservoir. Once the gangway has come to rest on the ship's deck, the jack 36 is automatically disconnected so that the gangway is held in resting support by its own weight. The rolling and pitching of the ship are passed on to the gangway which oscillates about the vertical axle 8 and about the horizontal axles 15 and 16.

On the contrary, any axial horizontal displacements of the ship cause the air cushion to slide on the ship's deck and are not transmitted to the gangway.

The pulling force exerted by the ship on the bridle keeps the gangway directly in line with the boat and the air cushion comes and goes along the longitudinal axis of the ship over a distance which is equal to the variations in length of the bridle, which bridle is kept constantly stretched by the forward thrust of the propellers.

At this stage, all the conditions required before any crew or light material can be trans-shipped safely through the gangway are gathered.

At the end of the trans-shipment, the gangway is raised by means of the jack 36 and at high speed so that the gangway cannot possibly be caught and hit in any way by the ship's deck moving under the swell.

The jack comprises an end-of-stroke abutment which cuts off automatically the supply to the jack when the gangway reaches a high position, and locks said jack in that rest position.

The umbilical 21 is then isolated from the sources of compressed air and pressurized oil, and it is disconnected. The forward thrusts of the propellers are reduced and the end 18 of the bridle is released, this causing the bridle to be immediately recalled under the gangway by the band 19 and by the spring roller 20.

In the case of accidental dropping of the bridle and of the umbilical, during trans-shipment, or in the case of disconnection or accidental breakage of the umbilical, or else in the case of failure of the jack supply circuit, the gangway is immediately raised up by the energy stored in the oil and air accumulator 37.

In the case of air cushion supply failure or of accidental breakage of one of the lines of the bridle, without the umbilical being broken, the raising up of the gangway by the jack 36 is immediately controlled from the control desk 35*a*.

In the case of accidental breakage of one of the lines 17*a* or 17*b* of the bridle, the rotary dampening means 10, which is mounted on the head of the axle 8 prevents a harsh rotation of the gangway about the axle 8 under the effect of the rotation torque due to the pulling action of the unbroken line, this giving the operator time to raise up the gangway without any risk for the crew or equipment still on it.

According to a variant illustrated in FIG. 1, the directional drum 11 is extended downwards by a cylindrical skirt 38 in perforated sheet metal, which forms a shield descending into the sea at low tide, and which is designed to dissipate part of the energy of the swell and so shelter the area where the ship is anchored. Preferably, a plurality of compressed air pipes are placed inside said shield, which pipes issue at the lower part of the shield under the waterline. Said pipes 39 are supplied with compressed air via the umbilical 21 during the trans-shipment operations.

The compressed air returns to the surface, creating inside the shield a barrier of bubbles which reduces the swell of the sea upstream of the ship or under the ship during the trans-shipment operations.

Figure 4:
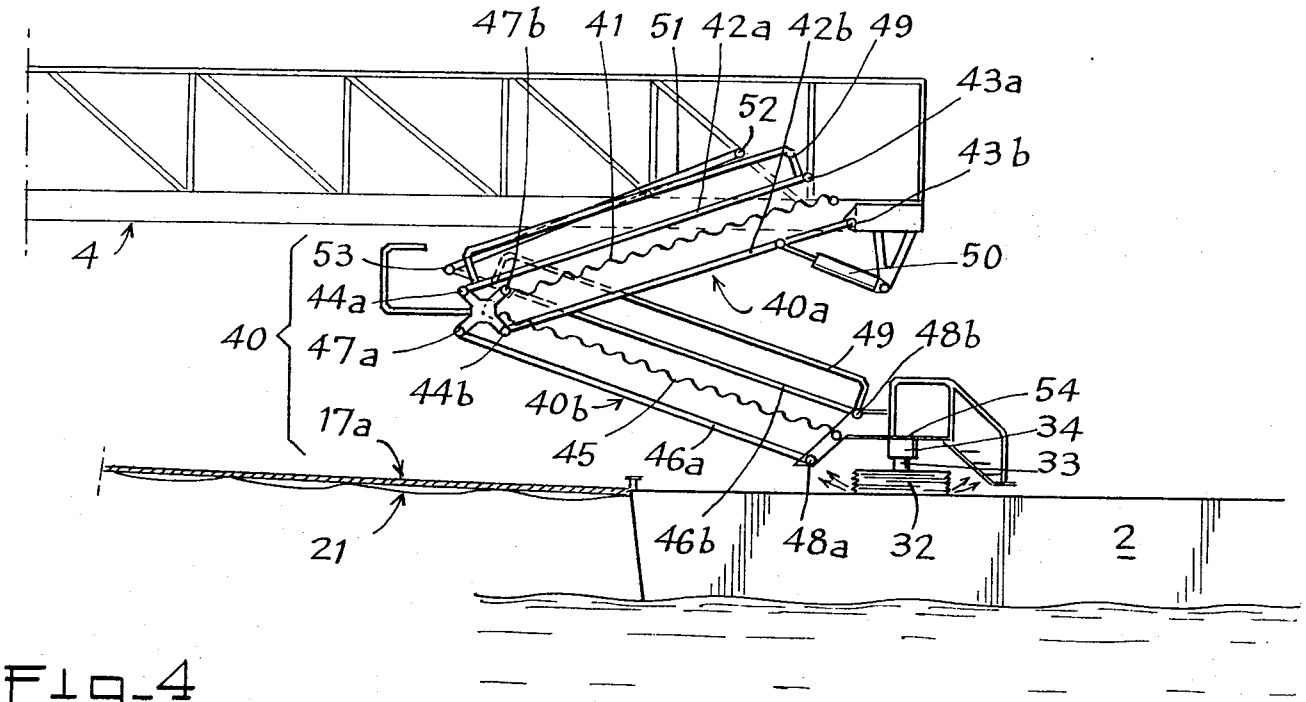
FIG. 4 is a partial elevation of a variant of embodiment of a gangway according to the invention.

FIG. 4 shows a partial view of the free end of the gangway in a variant embodiment which differs from that shown in FIGS. 1 to 3 in that the gangway 4 is substantially horizontal and fixed in console-manner on a fixed structure, whilst being mounted for pivoting about a vertical axle only, this permitting to direct it in line with the ship.

In this case, since the height which separates the gangway from the ship's deck can be relatively great when the tide is low, the one-flight stairway is replaced by a stairway 40 comprising a plurality of flights hingedly connected together, so that the height of the stairway is extendable. Said flights of stairs are set back laterally with respect to the gangway and they are set back with respect to one another.

FIG. 4 shows an example of embodiment wherein the stairway 40 comprises two flights 40*a* and 40*b*. The upper flight comprises, on either side of the steps 41, two side-members 42*a* and 42*b* which are hingedly mounted on their ends respectively on axles 43*a*, 44*a*, and 43*b*, 44*b*, and form an articulated parallelogram. Similarly, the flight of stairs 40*b* comprises steps 45 supported by two side-members 46*a* and 46*b*. Said side-members 46*a* and 46*b* are hinged at their two ends respectively about axles 47*a*, 47*b* and 48*a*, 48*b*. The flights of stairs are provided with guard-rails 49. The lower end of the lower flight 40*b* is provided with an access platform 54 resting on the ship's deck via an air cushion 42, a hinged connection 33 and an oil and air suspension 34 fulfilling the same functions the similar elements shown in FIG. 1 with the same reference numerals.

Due to the articulated parallelograms, the steps and the access platform 54 remain constantly horizontal.

A jack 50 controls the movements of the upper flight. A connecting rod 51 is hingedly connected by one of its ends 52 on the gangway 4 and by its other end 53, on an extension of the side member 46*a*.

When the upper flight 40*a* goes up or down, the connecting rod 51 forces the lower flight 40*b* to follow the movements of the upper flight, so that the two flights unfold or fold up symmetrically by pivoting of the same angle. The same applies when the stairway unfolds or folds up to follow the vertical movements of the ship. In the case where the stairway comprises more than two flights, each flight is connected to the upper flight by a connecting rod identical to the connecting rod 51.

In this variant, the vertical movements of the ship are compensated by the overall height variations of the extending stairway and when the height of the stairway varies, the air cushion 32 moves whilst remaining on the same vertical line.

The invention is not limited to the description given hereinabove and of course various modifications or additions can be brought thereto without departing from its scope or its spirit.

What is claimed is:

1. Device for trans-shipment of crews or light equipment between a ship and a fixed structure at sea, comprising a directional gangway, one end of which is mounted for pivoting on the fixed structure about a vertical axle, means for pivoting the said gangway about the said axle, and an air cushion designed to rest on a free area on the ship's deck for supporting the second end of the gangway by simple sliding support.

2. The device of claim 1, comprising a stairway which is hingedly joined to the second end of the gangway and which rests on a free area of the ship's deck via an air cushion.

3. The device of claim 2, wherein the lower end of the said stairway is joined to the air cushion by means of a suspension which may be an oil and air suspension, and of a swivel joint.

4. The device of claim 2, comprising a directional drum which pivots about a vertical axle and comprises two portions of vertical cylinder, centred on the said vertical axle and two arms connecting together two ends of the said cylinder portions, which arms and cylinder portions are symmetrical in pairs with respect to an axial plane, and it comprises two ropes of equal length one end of which is secured respectively to the free end of each arm, the other ends being fixed to a joint securing member which is designed to be moored to the rear end of the ship so that when said ship pulls on the ropes said ropes rest against the cylinder portion and exert on the directional drum a constant torque which brings the said axial plane of symmetry and the directional gangway in the axis of the ship.

5. The device of claim 4, wherein the directional drum is extended downwards by a cylindrical shield made of perforated sheet metal which descends under the water line and wherein air injection pipes are provided inside the said shield, which tubes have air injecting orifices situated under the water line.

6. The device of claim 1 comprising a rotary dampening means associated to the head of the vertical axle.

7. The device of claim 4, wherein the said gangway is composed of longitudinal side-members and of a girder which form a parallelogram articulated about four horizontal axes two of which are pivotally mounted on the structure supporting the stairway.

8. The device of claim 7 wherein the said drum supports two vertical axles which constitute two of the articulations of the said articulated parrallelogram and which are perpendicular to the said plane of axial symmetry.

9. The device of claim 7 comprising a jack for raising up the gangway and an umbilical cable connecting said jack and the air cushion to sources of compressed fluid situated on board the ship which umbilical cable is suspended to the said ropes, which ropes are suspended by way of a band to a spring roller fixed under the gangway.

10. The device of claim 9, further comprising an oil and air accumulator which controls the said jack in the event of the said umbilical cable breaking and which raises up the gangway.

11. The device of claim 2 wherein the said directional gangway is substantially horizontal and the said stairway is an extending stairway composed of a plurality of flights hingedly connected one to the other and folding up or unfolding under the action of a jack and of connecting rods, the lower end of the lower flight being fitted with an air cushion which comes in resting contact on the ship's deck.

12. Method of trans-shipment at sea between a ship and a fixed structure, using a device as claimed in claim 9, consisting in the ship approaching the said fixed structure stern first, an operator hooking the hooking member with a boathook and tieing it to the ship, and in said operator connecting the end of the said umbilical cable to a connector; in causing the ship to go forward at low speed in order to stretch the ropes and bring the gangway in line with the boat; and in descending the gangway until the air cushion comes in resting contact with the after deck of the ship then the trans-shipment can be effected.

* * * * *